US007717142B2

(12) United States Patent
Padar

(10) Patent No.: US 7,717,142 B2
(45) Date of Patent: May 18, 2010

(54) METHOD FOR THE PRODUCTION OF A FILLED METERING PUMP ARRANGEMENT

(75) Inventor: Steven Padar, Theresenstrasse 17, D-65779 Kelkheim (DE)

(73) Assignee: Steven Padar, Kelkheim (DE)

( * ) Notice: Subject to any disclaimer, the term of this patent is extended or adjusted under 35 U.S.C. 154(b) by 919 days.

(21) Appl. No.: 11/412,466

(22) Filed: Apr. 27, 2006

(65) Prior Publication Data

US 2006/0255073 A1 Nov. 16, 2006

(30) Foreign Application Priority Data

Apr. 27, 2005 (DE) ..... 10 2005 019 969

(51) Int. Cl.
*B65B 1/04* (2006.01)
*B65D 83/00* (2006.01)

(52) U.S. Cl. ..... 141/26; 141/20; 141/25; 141/302; 222/401

(58) Field of Classification Search ..... 141/18, 141/20–26, 44, 49, 64, 103, 302; 222/95, 222/401, 402.1, 402.18
See application file for complete search history.

(56) References Cited

U.S. PATENT DOCUMENTS

| | | | | |
|---|---|---|---|---|
| 3,572,402 | A * | 3/1971 | Beffel | 141/3 |
| 3,642,035 | A * | 2/1972 | Marand | 141/20 |
| 5,144,788 | A | 9/1992 | Varlet | |
| 5,179,982 | A * | 1/1993 | Berube et al. | 141/20 |
| 5,730,326 | A * | 3/1998 | Kaeser | 222/95 |
| 6,085,945 | A * | 7/2000 | Fransen | 222/402.18 |
| 6,196,275 | B1 * | 3/2001 | Yazawa et al. | 141/3 |
| 6,607,012 | B2 * | 8/2003 | Yquel | 141/20 |
| 6,666,355 | B2 | 12/2003 | Padar | |
| 7,225,839 | B2 * | 6/2007 | Mackenzie et al. | 141/20 |

FOREIGN PATENT DOCUMENTS

| | | |
|---|---|---|
| DE | 100 49 898 | 4/2002 |
| DE | 101 08 486 | 9/2002 |
| DE | 693 32 089 | 2/2003 |
| EP | 0 774 074 | 5/1997 |
| WO | WO 93/22200 | 11/1993 |

* cited by examiner

*Primary Examiner*—Timothy L Maust
(74) *Attorney, Agent, or Firm*—Collard & Roe, P.C.

(57) ABSTRACT

A method for the production of a filled metering pump arrangement fills a product capable of flow into a film bag, which is accommodated in a container. The film bag and the container are closed by means of a pump that can be activated manually, which blocks a fluid connection between an outlet opening and the interior of the film bag, in the unstressed state, by means of at least one kick-back valve. Furthermore, the gas situated in the film bag is removed, at least approximately completely, by having at least one feed channel remain open in the container after it has been closed by the pump. By means of the at least one feed channel, a fluid that is under pressure is introduced into the container so that the film bag is compressed in the container and as a result, the gases situated in the film bag are ejected from it through the pump and/or through a bypass channel that circumvents it.

12 Claims, 2 Drawing Sheets

METHOD FOR THE PRODUCTION OF A FILLED METERING PUMP ARRANGEMENT

CROSS REFERENCE TO RELATED APPLICATIONS

Applicant claims priority under 35 U.S.C. §119 of German Application No. 10 2005 019 696.0 filed Apr. 27, 2005.

BACKGROUND OF THE INVENTION

1. Field of the Invention

The present invention relates to a method for the production of a filled metering pump arrangement. More particularly, the method includes the steps of filling a product capable of flow into a film bag that is accommodated in a container, subsequently closing the film bag and the container by means of a pump that can be activated manually, which blocks a fluid connection between an outlet opening connected with the surroundings and the interior of the film bag, in the unstressed state, by means of at least one kick-back valve, and removing the gases situated in the film bag, at least approximately completely. Furthermore, the present invention relates to the use of such a metering pump arrangement.

2. The Prior Art

A dispensing device for fluids is known from DE 101 08 486 A1, with which liquid pharmaceuticals or cosmetics, for example, can be dispensed from a container in metered manner. The metering pump used for this purpose works without air equalization, whereby the fluid is accommodated within the container within an inner bag that is sealed relative to the surroundings, which bag collapses as it empties.

After such inner bags have been filled with fluids such as pharmaceuticals or cosmetics, residual air usually remains in the inner bag at first. However, this arrangement is undesirable for various reasons. For example, the oxygen is constantly in contact with the fluid during storage, which results in a reduction of the possible storage period or of the absence of germs in the fluid. It is true that this problem could be solved by filling the fluid container in a germ-free atmosphere or under inert gas, but because filling under such circumstances is very complicated and expensive, this method is not suitable for economically efficient production of metering pumps.

Furthermore, complete emptying of the bag is possible only if no residual air remains in the inner bag after it has been filled. The residual air in the inner container also has a disruptive effect if the dispensing device is not held straight, i.e. with the pump vertically on top, during activation. Thus, if the metering pump arrangement is not oriented completely vertically, residual air can be drawn in by the pump, and dispensed from the inner bag in place of the fluid. This requirement is particularly undesirable when administering medications, such as nose, eye or ear sprays. Holding the dispensing device precisely vertically for such applications is possible only with difficulties.

It is therefore proposed in DE 101 08 486 A1 to form a passage for the residual air to be drawn off, between the outer wall of the piston and the inner wall of the pressure cylinder of the metering pump. This passage connects with the inner bag, on the one hand, via an opening provided on the pump housing, and with the surroundings, on the other hand, via a valve-like flap within the pump. Any residual air remaining in the inner bag after it has been filled can be drawn off through this channel within the pump, in order to avoid the disadvantages mentioned above. However, forming this channel for the residual air in the inner bag presumes great precision in the production of the pump. Furthermore, the production of this known dispensing device is made more expensive by the complicated structure of the pump. With this known dispensing device, the metering pump projects into the inner bag with its pressure cylinder and its intake opening that is assigned to the kick-back valve on the inner bag side.

The valve in the dispensing head of this known dispensing device is formed so that it opens when the product to be dispensed flows out of the pump into the dispensing head under pressure, but is held closed via a spring as long as the product does not displace a sealing body counter to the spring pressure. As a results no residual air can be drawn towards the outside via this dispensing head. Drawing off the residual air is consequently possible only when the dispensing head has not yet been set onto the pump. However, this feature has the disadvantage that residual air always remains in the dispensing head, and this air must be removed from the dispensing head by a user, before first-time use, by means of activating the pump, before the product can be dispensed. Because air is compressible, and only small amounts of the product, for example approximately 28 mg, are dispensed with one pump stroke for the application of medications, for example, many pump strokes are often required for this application, which users consider unsatisfactory.

SUMMARY OF THE INVENTION

Against this background, it is an object of the present invention to provide a simplified method for the production of a filled metering pump arrangement, which is as easy to handle as possible, and with which the residual air that remains in the film bag after it has been filled can be removed with simplified means.

These and other objects are accomplished, according to the invention, substantially by having at least one feed channel remain open in the container after it has been closed by the pump. By means of this feed channel or channels, a fluid that is under pressure is introduced into the container so that the film bag is compressed in the container and as a result, the gases situated in the film bag are ejected from it through the pump and/or through a bypass channel that circumvents it. By ejecting the residual air through the pump itself or through a bypass channel, complete emptying of air from the film bag can be achieved even with pumps or dispensing heads that do not permit drawing off the residual air. The metering pump arrangement is therefore ready for operation, and the product capable of flow can already be dispensed with the first pump stroke by a user. In this way, the ease of operation of the metering pump arrangement is significantly increased.

The structure of the pump can also be kept particularly simple. Thus, the kick-back valves can be formed either by balls that are pressed against corresponding valve seats, for example, by means of pressure springs, or by rubber lips or similar elastic elements, which close off a valve seat in the unstressed state and can be lifted off from it by means of fluid pressure, for example.

In a further embodiment, at least one kick-back valve of the pump opens during ejection and thereby produces a fluid connection between the outlet opening and the interior of the film bag. In this connection, the balls, sealing lips, or the like are lifted off from their valve seat, counter to the elastic closing forces. After ejection of the residual air, the kick-back valves close automatically, so that renewed penetration of air into the container is avoided. Ejection of the residual air from the container can take place in a state of the metering pump arrangement in which only the pump, with one kick-back valve, for example, but without a dispensing head, which usually has another kick-back valve, is provided on the container. Alternatively, ejection takes place through the pump and the dispensing head, i.e. through both kick-back valves, which are opened during this process. In the case of the alternative first mentioned, where only the pump without a dispensing head is provided on the container, the dispensing head or the like can be affixed to the pump subsequently. In the sense of the invention, the outlet opening can therefore be formed either by a nozzle or the like on the dispensing head, or by any desired opening by means of which the pump can be connected with a dispensing head.

In the sense of the present invention, substances capable of flow are intended to include all substances that can be dispensed with such a pump. These substances can be not only low-viscosity substances but also highly viscous, paste-like, or gel-like substances.

Preferably, the film bag and the container are closed off via a lid, particularly a flange-like lid, which is connected with the film bag and the container, forming a seal. This arrangement makes it possible for the container and the film bag to be closed jointly, in one work step. Afterwards, however, the container continues to have its open feed channel, so that compressed air or the like can be introduced into the container, in order to eject the residual air from the film bag. In this connection, the lid can be formed from a more rigid material. In this way, the lid can be well connected with the container, which is also more rigid, for example, and forms a housing for accommodating the collapsible film bag.

Emptying the residual air from the film bag, for example a collapsible film bag, is possible in particularly simple manner if, for ejection of the gas from the film bag, the container is situated in a position in which the pump is disposed vertically above the film bag. Then, the residual air can escape through an intake opening that is provided in the pump, for example at its vertically-lower end, facing the lid. In this connection, it is preferred if the intake opening for ejecting the gases situated in the film bag is provided on the pump in such a manner that the intake opening does not project or at least does not significantly project into the film bag.

Alternatively, a first intake opening for dispensing the product capable of flow, and another second opening for ejecting the gases situated in the film bag can be provided, which second opening does not project or at least does not significantly project into the film bag.

Preferably the pump has a pressure chamber having a piston guided in this piston chamber, a first kick-back valve, which connects the pressure chamber with the container, and a second kick-back valve that is assigned to a dispensing head, if applicable. In this connection, the first kick-back valve permits a flow out of the container into the pressure chamber, if a lower pressure prevails there than in the container, while any flow in the opposite direction is fundamentally blocked. Accordingly, the second kick-back valve permits a flow out of the pressure chamber into the surroundings, if the pressure in the pressure chamber exceeds a defined value, while preventing a return flow, for example from the surroundings into the pressure chamber. The kick-back valves can be configured as balls that are elastically pressed against a valve seat by means of a spring, for example.

Alternatively, it is also possible to form the kick-back valves merely by means of a sealing lip that lies on a valve seat in the unstressed state, and can be lifted elastically off the valve seat by means of fluid pressure.

Fundamentally, any and all kick-back valves that prevent return flow of air or the like into the container and allow dispensing of the fluid from the container when the pressure in the container or in the pressure chamber, respectively, is greater than in the pressure chamber or in the surroundings, respectively, can be used for the metering pump arrangement according to the invention.

Alternatively to the configuration of the pump as described, with a piston and a pressure chamber, it is also possible to provide a pump in the manner of a bellows, or another suitable pump device. The second kick-back valve can be provided in a dispensing head that can be removed from the pressure chamber or piston chamber, if necessary. Ejection of the residual air can take place with or without the dispensing head. The variant first mentioned offers the advantage, in this connection, that air is removed from the dispensing head, as well, so that the metering pump arrangement is ready for use.

Because the metering pump arrangement according to the invention works without air equalization, the film bag must have a changeable volume. A changeable volume is made possible, in a particularly simple manner, by forming the film bag from a flexible, collapsible material. While the film bag is being emptied, the bag consequently draws or folds together.

Ejection of the residual air from the film bag, according to the invention, by means of compressed air introduced into the container, or the like, can also take place by providing a region for accommodating residual air, connected in terms of flow with the interior of the film bag, on the pump, on the lid and/or on the film bag. In this region, gases situated in the film bag are accommodated in a defined orientation of the container. A line connected with the pump and/or a bypass projects into this region for ejecting the gases situated in the film bag. The region for accommodating residual air can be formed, for example, by means of a dome or the like in the container or the lid, so that the residual air collects in this region in a specific position of the container, and can be ejected from there.

If ejection of the residual air takes place through a bypass channel, the bypass channel is closed off after ejection of the gases situated in the film bag, in order to prevent renewed penetration of air or contamination of the product accommodated in the film bag.

Preferably, the film bag is provided with a flange-like edge. With this edge the film bag may be inserted into the container, particularly into a groove-like accommodation of the container, before or after the product capable of flow has been filled in. The container and the film bag can then be closed off with simple means, by means of setting on the lid and/or the pump.

Depending on the intended use of the metering pump arrangement, the outlet opening can be formed, for example, by means of a nozzle for atomizing the liquid content of the container. However, it is also possible to structure the outlet opening in another manner, for example to dispense individual, larger drops of a fluid by means of the metering pump arrangement. The metering pump arrangement according to the invention is particularly suitable for metering, dispensing, applying, or the like, liquid cosmetics and/or pharmaceuticals.

BRIEF DESCRIPTION OF THE DRAWING

Other objects and features of the present invention will become apparent from the following detailed description considered in connection with the accompanying drawings. It should be understood, however, that the drawings are designed for the purpose of illustration only and not as a definition of the limits of the invention.

In this connection, all of the characteristics described and/or shown in the drawings represent embodiments of the invention, in themselves or in any desired combination, independent of how they are combined in the claims or their antecedents.

In the drawings,

FIG. 1 shows a schematic sectional view of a metering pump arrangement in accordance with an aspect of the invention;

FIG. 2A shows a detail of area A of FIG. 1; and

FIG. 2B shows a detail of area B of FIG. 2.

DETAILED DESCRIPTION OF PREFERRED EMBODIMENTS

Figure 1:
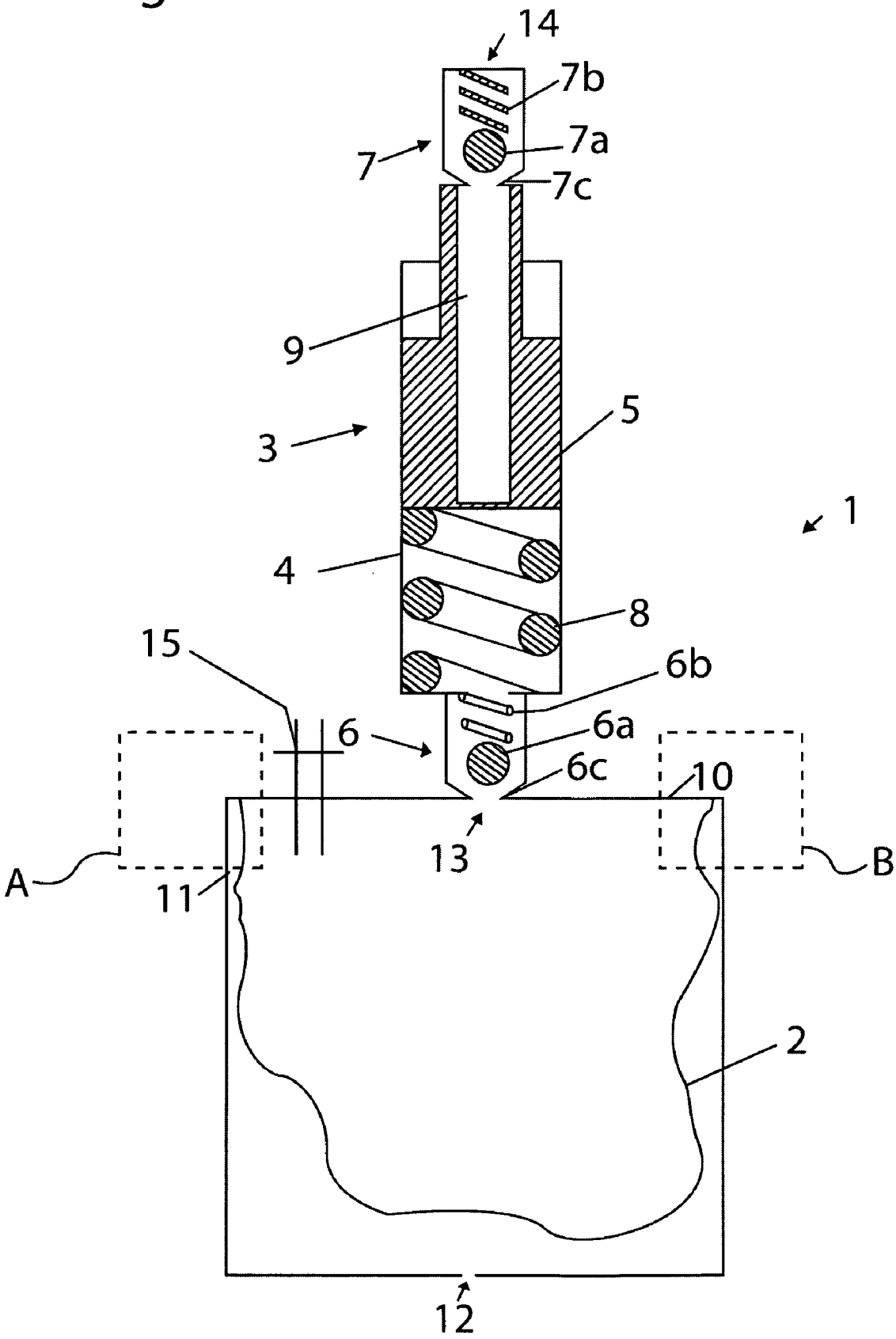

Turning now in detail to the drawing, FIG. 1 shows a metering pump arrangement 1 which has a collapsible film bag 2, which is filled with a fluid, for example a liquid pharmaceutical or cosmetic product. As will be explained in greater detail below, film bag 2 is connected with a pump 3, in sealed manner, which pump, in the embodiment shown, includes a pressure chamber 4 having a piston 5 that glides in it, and two kick-back valves 6 and 7, respectively.

In pressure chamber 4, a spring B is provided so that piston 5 is impacted upward in FIG. 1. Piston 5 has a central passage opening 9, through which a fluid can be pumped out of film bag 2 into the surroundings.

For this purpose, the first kick-back valve 6 is set so as to permit flow out of film bag 2 into pressure chamber 4 if the ball-shaped valve element 6*a* is lifted off its valve seat 6*c* by means of a partial vacuum in pressure chamber 4, counter to the force of valve spring 6*b*. In the opposite direction, however, flow out of pressure chamber 4 into film bag 2 is blocked via first kick-back valve 6.

Furthermore, second kick-back valve 7 is disposed so that when there is excess pressure in pressure chamber 4, fluid can escape into the surroundings through kick-back valve 7, in that valve body 7*a* is lifted from its valve seat 7*c* counter to the force of valve spring 7*b*. In contrast, flow of ambient air, for example, back into pressure chamber 4, is prevented by kick-back valve 7. Second kick-back valve 7 is shown as a component of pump 3 in FIG. 1. Alternatively, the second kick-back valve can also be assigned to a dispensing head that can be attached to pump 3. In this connection, the second kick-back valve does not have to be configured as shown in FIG. 1, but rather can also be configured as described in DE 101 08 486 A1.

Figure 2A:
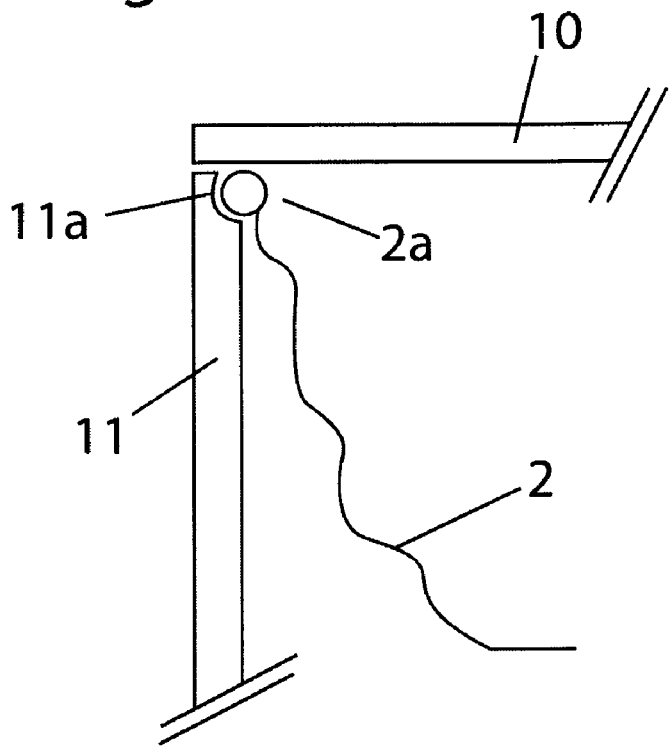
Figure 2B:
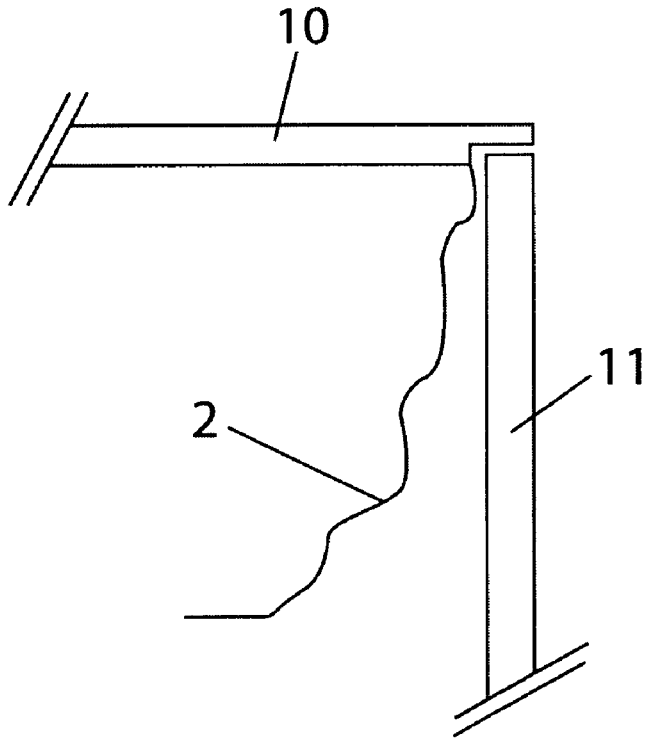

In the embodiment shown, film bag 2 is provided with a flange-shaped lid 10 shown in FIGS. 2A and 2B, for example a reinforced lid, which seals pump 3 relative to film bag 2. For this purpose, lid 10 can be cast onto pump 3, or welded to it. In the same manner, a circumferential edge of the collapsible film bag 2 can be welded to the edge region of the rigid lid 10, glued, or connected in another suitable manner so as to form a seal. Film bag 2 is accommodated in a container 11, which is also rigid, for example, and is rigidly or releasably connected with lid 10. Film bag 2 has a flange-shaped edge 2*a* shown in FIG. 2A for inserting the film bag into container 11 before or after the product capable of flow has been filled in. As shown in FIG. 2A, container 11 has a groove-shaped accommodation 11*a* for flange-shaped edge 2*a*. A ventilation opening or feed channel 12 is provided in container 11, 50 that film bag 2 can freely unfold or contract within container 11, without this movement being hindered by an excess pressure or partial vacuum in container 11. At the same time, compressed air or the like can also be applied to container 11 by means of this ventilation opening 12, as will be explained below.

Pump 3 has an intake opening, shown as a lower intake opening 13 in the FIG. 1, which opens into film bag 2, and an outlet opening, shown as an upper outlet opening 14 in the Figure, which stands in connection with the surroundings. In this connection, pump 3 and intake opening 13 are disposed on film bag 2 and lid 10, respectively, so that intake opening 13 does not project or at most projects minimally beyond lid 10 into film bag 2, in the embodiment shown. In this way, it is possible to eject an air bubble of residual air, which forms in film bag 2 above the fluid, not shown, through pump 3 or through a bypass channel 15 including close-off means circumventing puma 3.

For this purpose, a medium under pressure is pressed into container 11, which is closed off with a lid 10, through ventilation opening 12 that acts as a feed channel. Because of the excess pressure in container 11, film bag 2 is compressed, and the residual air can escape through pump 3, causing valve bodies 6*a* and 7*a* to lift from their valve seats 6*c* and 7*c*, respectively, counter to the force of valve springs 6*b* and 7*b*, respectively. As soon as fluid is drawn in through intake opening 13 and exits from outlet opening 14, there is no longer any residual air in film bag 2 and pump 3 or the dispensing head, respectively. After the ejection of the residual air is completed, the two kick-back valves 6 and 7 close again, due to the force of valve springs 6*b* and 7*b*, respectively, so that no ambient air can flow back into film bag 2. The compressed air or the like can escape through ventilation opening 12, which remains open in order to permit pressure equalization between the interior of container 11 and the surroundings while film bag 2 is being emptied.

If the second kick-back valve is provided in a dispensing head (not shown in the FIGS.), the residual air can be ejected from film bag 2 either before or after the dispensing head is set on. In the case first mentioned, only first kick-back valve 6 opens during dispensing of the residual air, and afterwards prevents return flow of air into film bag 2. In contrast, if the dispensing head is set on while the residual air is dispensed, both kick-back valves 6 and 7 open, as described above.

The central passage opening 9 of pump 3 and the dispensing head are also filled with the product after complete ejection of the residual air from metering pump arrangement 1, if the excess pressure in container 11 remains built up. In this way, a user can already dispense the product capable of flow with the first pump stroke. He or she does not have to first fill pump 3 by means of several pump strokes, before first-time use of metering pump arrangement 1.

Although at least one embodiment of the present invention has been shown and described, it is to be understood that many changes and modifications may be made thereunto without departing from the spirit and scope of the invention as defined in the appended claims.

What is claimed is:

1. A method for producing a filled pump arrangement comprising the steps of:

(a) filling a product capable of flow into a film bag accommodated in a container having at least one feed channel; and (b) closing the film bag and the container using a manually-activated pump to block a fluid connection between an outlet opening and an interior portion of the bag using at least one kick-back valve in an unstressed state;

wherein the at least one feed channel remains open in the container after the container has been closed by the pump for introduction of a fluid under pressure through the at least one feed channel into the container in order to compress the film bag in the container and eject from the film bag gases through the pump or through a bypass channel circumventing the pump; and wherein the at least one feed channel remains open in order to permit pressure equalization between the interior of the container and the surroundings while the film bag is being emptied.

2. The method according to claim 1, wherein during election, at least one kick-back valve of the pump opens and thereby produces a fluid connection between the outlet opening and the interior portion of the film bag.

3. The method according to claim 1, wherein the film bag and the container are closed off by means of a lid connected with the film bag and the container to form a seal.

4. The method according to claim 3, wherein the lid is flange-shaped.

5. The method according to claim 3, wherein for ejection of the gases from the film bag, the container is situated in a position where the pump is disposed vertically above the film bag, and wherein the pump has an intake opening at a vertically lower end of the pump facing the lid.

6. The method according to claim 1, wherein the pump has an intake opening for ejecting the gases situated in the film bag and wherein the intake opening does not substantially project into the film bag.

7. The method according to claim 3, wherein the pump has a first intake opening for dispensing the product capable of flow and a second opening for ejecting the gases situated in the film bag and wherein the second opening does not substantially project beyond the lid into the film bag.

8. The method according to claim 3, wherein the pump, the lid or the film bag has a region for accommodating residual air connected in terms of flow with the interior portion of the film bag, wherein gases situated in the film bag are accommodated in the region in a selected orientation of the container and wherein a line connected with the pump or the bypass channel projects into the region for electing the gases situated in the film bag.

9. The method according to claim 1, wherein the bypass channel is closed off after ejection of the gases situated in the film bag.

10. The method according to claim 1, wherein the film bag has a flange-shaped edge for inserting the film bag into the container before or after the product capable of flow has been filled in.

11. The method according to claim 10, wherein the container has a groove-shaped accommodation for the flange-shaped edge.

12. A method for metering, dispensing or applying liquid cosmetics or pharmaceuticals comprising the steps of:

(a) providing a filled pump arrangement produced by the method according to claim 1; and (b) using the filled pump arrangement to meter, dispense or apply the cosmetics or pharmaceuticals.

* * * * *